US010535971B2

(12) United States Patent
Annis et al.

(10) Patent No.: US 10,535,971 B2
(45) Date of Patent: Jan. 14, 2020

(54) ELECTRICAL CONNECTOR

(71) Applicant: TE CONNECTIVITY CORPORATION, Berwyn, PA (US)

(72) Inventors: Kyle Gary Annis, Hummelstown, PA (US); Keith Edwin Miller, Manheim, PA (US); Kevin Michael Thackston, York, PA (US); Rutger Wilhelmus Smink, Achel (BE); Jacobus Nicolaas Tuin, HC Best (NL)

(73) Assignees: TE CONNECTIVITY CORPORATION, Berwyn, PA (US); TE CONNECTIVITY NEDERLAND BV, Ar's-Hertogenbosch (NL)

( * ) Notice: Subject to any disclaimer, the term of this patent is extended or adjusted under 35 U.S.C. 154(b) by 154 days.

(21) Appl. No.: 15/730,982

(22) Filed: Oct. 12, 2017

(65) Prior Publication Data

US 2019/0115709 A1 Apr. 18, 2019

(51) Int. Cl.

| | |
|---|---|
| ***H01R 43/24*** | (2006.01) |
| ***H01R 13/405*** | (2006.01) |
| ***H01R 13/514*** | (2006.01) |
| ***H01R 12/00*** | (2006.01) |
| ***H01R 13/648*** | (2006.01) |
| *H01R 13/504* | (2006.01) |
| *H01R 13/58* | (2006.01) |

(52) U.S. Cl.

CPC ..... *H01R 43/24* (2013.01); *H01R 12/00* (2013.01); *H01R 13/405* (2013.01); *H01R 13/514* (2013.01); *H01R 13/6485* (2013.01); *H01R 13/504* (2013.01); *H01R 13/5845* (2013.01)

(58) Field of Classification Search

CPC ..... H01R 43/24

See application file for complete search history.

(56) References Cited

U.S. PATENT DOCUMENTS

| | | | |
|---|---|---|---|
| 6,471,549 | B1 | 10/2002 | Lappohn |
| 7,044,794 | B2 | 5/2006 | Consoli et al. |
| 7,172,461 | B2 | 2/2007 | Davis et al. |
| 7,566,247 | B2 | 7/2009 | Rothermel et al. |
| 7,637,767 | B2 | 12/2009 | Davis et al. |
| 2002/0098738 | A1 | 7/2002 | Astbury, Jr. et al. |
| 2005/0070160 | A1 | 3/2005 | Cohen et al. |
| 2007/0155241 | A1 | 7/2007 | Lappohn |
| 2008/0203547 | A1 | 8/2008 | Minich |
| 2014/0273557 | A1 | 9/2014 | Cartier, Jr. et al. |

(Continued)

OTHER PUBLICATIONS

European Search Report, dated Feb. 11, 2019, EP 18 19 9380, International Application No. 18199380.9-1801.

*Primary Examiner* — James Harvey

(57) ABSTRACT

An electrical connector includes a contact leadframe of unitary construction including first contacts extending to second contacts via corresponding leads, and an overmolded contact module housing formed over the leadframe, forming a connector module. The connector further includes the housing embedding the leads and surrounding the first contacts, the second contacts extending from the housing. The connector further includes a first surface of the first contacts in contact with the housing, and an opposed second surface of the first contacts being exposed. The connector includes a plurality of connector modules positioned in an aligned arrangement.

20 Claims, 11 Drawing Sheets

(56) References Cited

U.S. PATENT DOCUMENTS

| | | | | |
|---|---|---|---|---|
| 2014/0273663 | A1* | 9/2014 | Cartier, Jr. | H01R 43/16 439/692 |
| 2014/0322985 | A1 | 10/2014 | Gulla | |
| 2019/0027872 | A1* | 1/2019 | Yuan | H01R 13/405 |
| 2019/0115709 | A1* | 4/2019 | Annis | H01R 12/00 |

* cited by examiner

ELECTRICAL CONNECTOR

FIELD OF THE INVENTION

The present invention is directed to electrical connectors, and more particularly, to electrical connectors having a plurality of contacts protected by a plastic overmold in the unmated state.

BACKGROUND OF THE INVENTION

Some electrical connectors have a mating end wherein conductive terminals are exposed for engagement with the terminals of a mating connector. This is common in a right angled connector used for interconnecting circuit boards such as a back plane and a daughter board. The back plane typically has a connector, commonly referred to as a receptacle, that mates with a daughter board connector, commonly referred to as a header. Portions of the terminals in either the receptacle or header are often exposed for engagement with the terminals of the header connector.

In at least some right angled receptacle connectors, the receptacle includes a plurality of wafers or exposed contact pins, each of which includes signal carrying traces and ground traces along with signal and ground contact pads. Applying these traces to wafers is expensive. Alternately, overmolding conductive stamped layers, sometimes referred to as leadframes, have been utilized in place of the wafers to manufacture these connectors. However, prior to mating with the daughter board, the exposed, elongated contacts of the connector are fragile and susceptible to damage.

A need remains for a connector that addresses these shortcomings in a cost effective manner and without adding to the size or complexity of the connector.

SUMMARY OF THE INVENTION

An embodiment is directed to an electrical connector including a contact leadframe of unitary construction including first contacts extending to second contacts via corresponding leads, and an overmolded contact module housing formed over the leadframe, forming a connector module. The connector further includes the housing embedding the leads and surrounding the first contacts, the second contacts extending from the housing. The connector further includes a first surface of the first contacts in contact with the housing, and an opposed second surface of the first contacts being exposed. The connector includes a plurality of connector modules positioned in an aligned arrangement.

A further embodiment is directed to an electrical connector includes a contact leadframe of unitary construction including first contacts extending to second contacts via corresponding signal leads and a third contact positioned in close proximity to the first contacts. The connector further includes an overmolded contact module housing formed over the leadframe, forming a connector module, the housing embedding the leads and surrounding the first contacts and the third contact, the second contacts extending from the housing. The connector further includes a first surface of each of the first contacts and the third contact in contact with the housing, and an opposed second surface of each of the first contacts and the third contact being exposed, and a ground member connected to the third contact. The connector includes a plurality of connector modules positioned in an aligned arrangement.

A yet further embodiment is directed to a method of forming a connector includes positioning a contact leadframe of unitary construction including first contacts extending to second contacts via corresponding signal leads. The method further provides forming an overmolded contact module housing over the leadframe, forming a connector module, the housing embedding the leads and surrounding the first contacts, the second contacts extending from the housing, a first surface of the first contacts in contact with the housing, and an opposed second surface of the first contacts being exposed. The method further provides positioning a plurality of connector modules in an aligned arrangement.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The description of illustrative embodiments according to principles of the present invention is intended to be read in connection with the accompanying drawings, which are to be considered part of the entire written description. Terms such as "attached," "affixed," "connected," "coupled," "interconnected," "engaged," "installed" and the like refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 1:
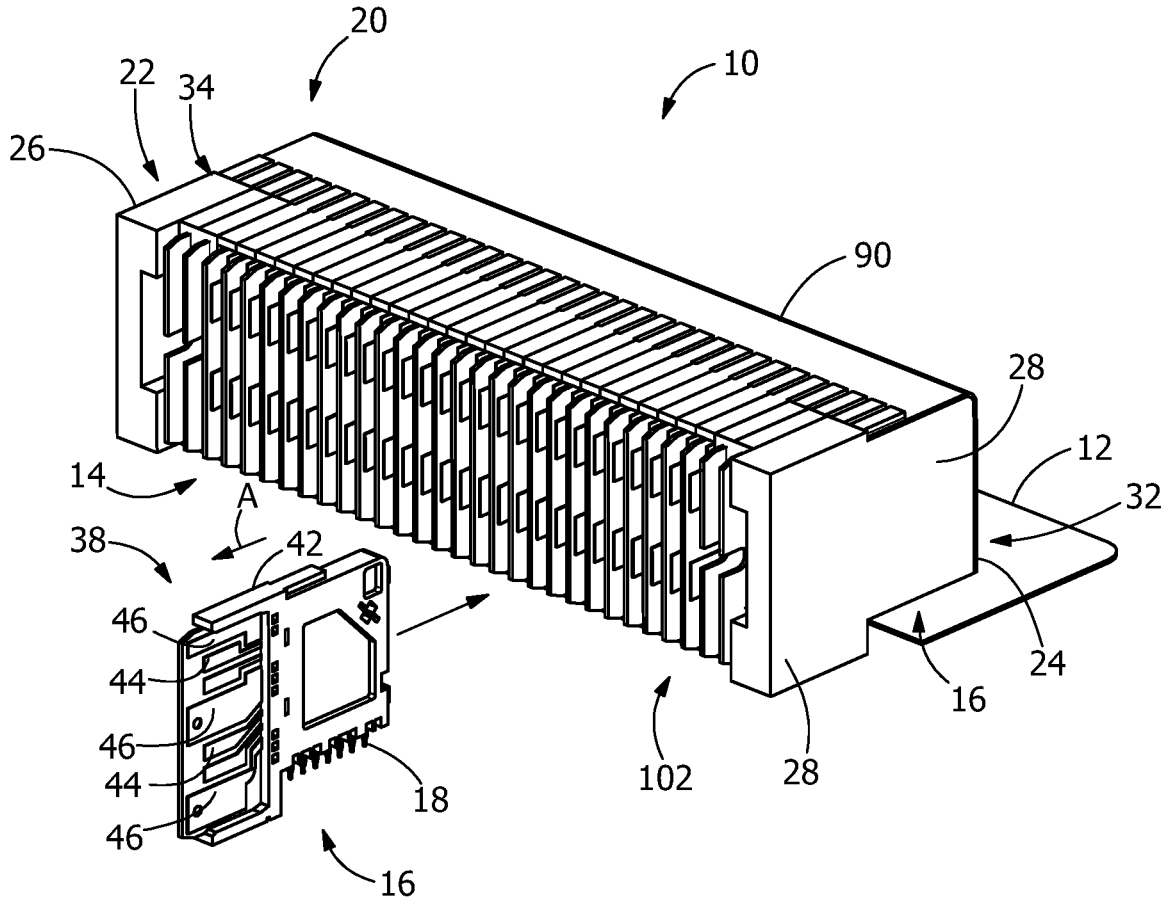
FIG. 1 is a perspective view of an exemplary connector according to the present invention.

FIG. 1 illustrates a perspective view of an electrical connector 10 formed in accordance with an exemplary embodiment of the present invention. The connector 10 is a header connector that is configured to be mounted on a circuit board 12 which in an exemplary embodiment is a daughter board. As shown, the connector 10 has a mating face 14 and a mounting interface 16 having outwardly extending contacts 18 for mounting the connector 10 to the circuit board 12. In an exemplary embodiment, the mounting interface 16 is substantially perpendicular to the mating face 14 such that the header connector 10 interconnects electrical components that are substantially at a right angle to each other. The mating face 14 of the connector 10 defines a back plane connector interface. In one embodiment, the connector 10 may be used to interconnect a daughter board to a back plane circuit board. In other embodiments, the connector 10 may be configured to interconnect electrical components that are at other than a right angle to each other.

While the invention will be described in terms of a connector carrying differential signals, it is to be understood that the following description is for illustrative purposes only and is but one potential application of the inventive concepts herein. It is appreciated that the benefits and advantages of the invention may accrue equally to other types of signal connectors and power connectors.

Figure 9:
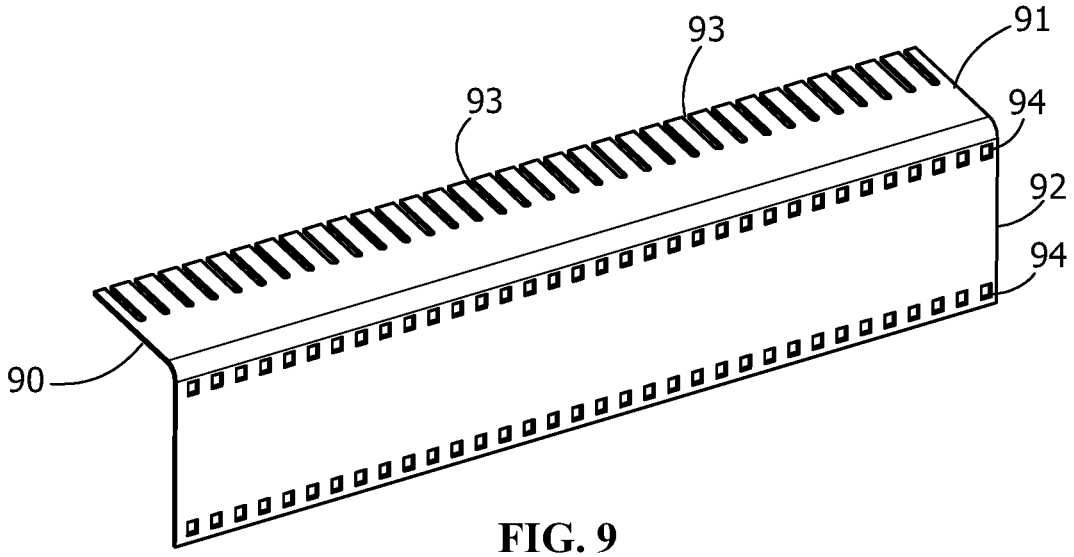
FIG. 9 is an upper perspective view of an exemplary clip according to the present invention.

The connector 10 includes a dielectric overmolded contact module housing 20 that has an upper housing portion 22 and a lower housing portion 24. The upper housing portion 22 includes upper and lower shrouds 26 and 28, respectively that are proximate the mating face 14 of the connector 10. Upper shroud 26 and lower shroud 28 extend forwardly from upper housing portion 22 in the direction of arrow A, which is also the mating direction of the connector 10. Upper housing portion 22 includes opposed ends 32, 34. Upper and lower housing portions 22, 24 are coupled together forming an open framework for holding a plurality of connector modules 38 that are received into housing 20 with a clip 90 (FIG. 9) that is part of upper shroud 26 in one embodiment. Clip 90 includes a plurality of slots 36 that help position and align the connector modules 38 to facilitate mating with a mating connector (not shown in FIG. 1).

Connector modules 38, sometimes referred to as chicklets or chicklet assemblies, include signal or power contacts or contact pads or contacts 44 and ground contact pads or contacts or ground contacts 46. Ground contacts 46 have a length measured in the direction of arrow A that is greater than a corresponding length of the signal contacts 44. In one embodiment, the connector 10 is a high speed connector that carries differential signals and the signal contacts 44 and ground contacts 46 are arranged in an alternating pattern wherein pairs of signal contacts 44 are separated by a ground contact 46. For instance, as shown in FIG. 1 for the exemplary connector module 38 temporarily extracted from connector 10 for purposes of discussion, the connector module 38 starts at the bottom with a ground contact 46 adjacent the lower shroud 28 and extends upwardly to a pair of signal contacts 44 adjacent the lower shroud 28, followed by a generally centrally positioned ground contact 46, further extending upwardly to another pair of signal contacts 44 adjacent upper shroud 26, ending at the top with another ground contact 46 adjacent the upper shroud 26. In one embodiment, the arrangement of contacts 44, 46 may be different. In one embodiment, different arrangements of contacts 44, 46 may be incorporated into different connector modules 38, such as adjacent connector modules of connector 10. The connector 10 is modular in construction and in the embodiment shown in FIG. 1 includes 26 connector modules 38 with a total of 52 differential signal pairs of contacts and four modules that deliver power. It is to be understood that in alternative embodiments, a greater or fewer number of the connector modules 38 may be used, and that the connector modules may be configured with a different number of differential signal pairs. The connector modules 38 project from the shrouds 26 and 28. One purpose of the ground contacts 46 is to provide electrostatic discharge (ESD) protection for the signal contacts 44 as discussed in additional detail in Applicant's U.S. Pat. No. 7,044,794 entitled "Electrical Connector with ESD Protection," which is hereby incorporated by reference in its entirety.

Figure 2:
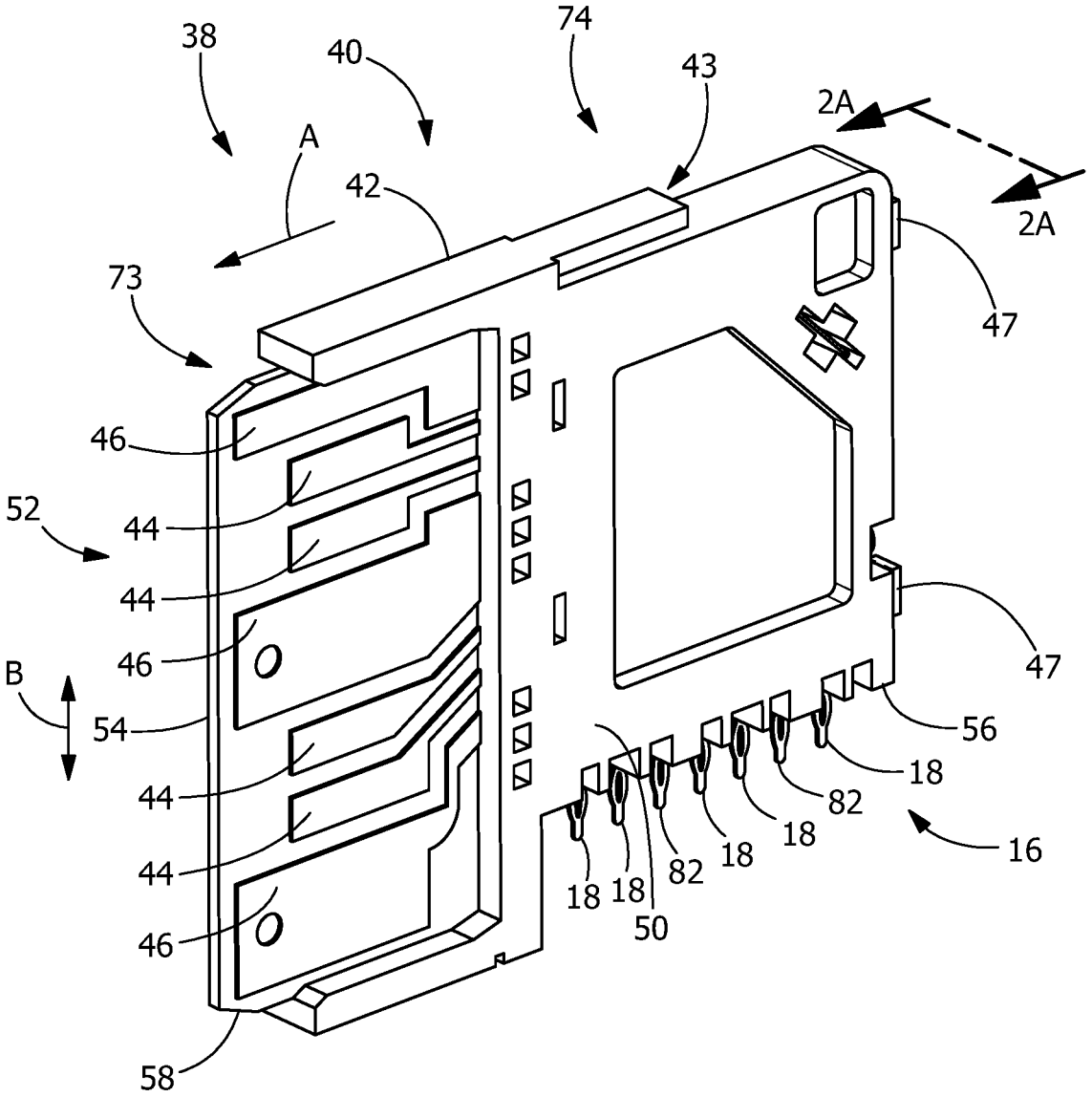
FIG. 2 is a front perspective view of an exemplary connector module according to the present invention.
Figure 2A:
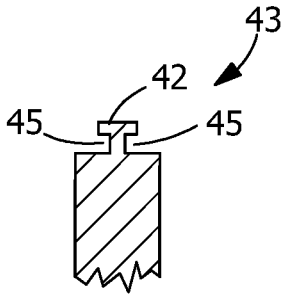
FIG. 2A is a cross-section taken along lines 2-2 taken from the connector module of FIG. 2 according to the present invention.
Figure 10:
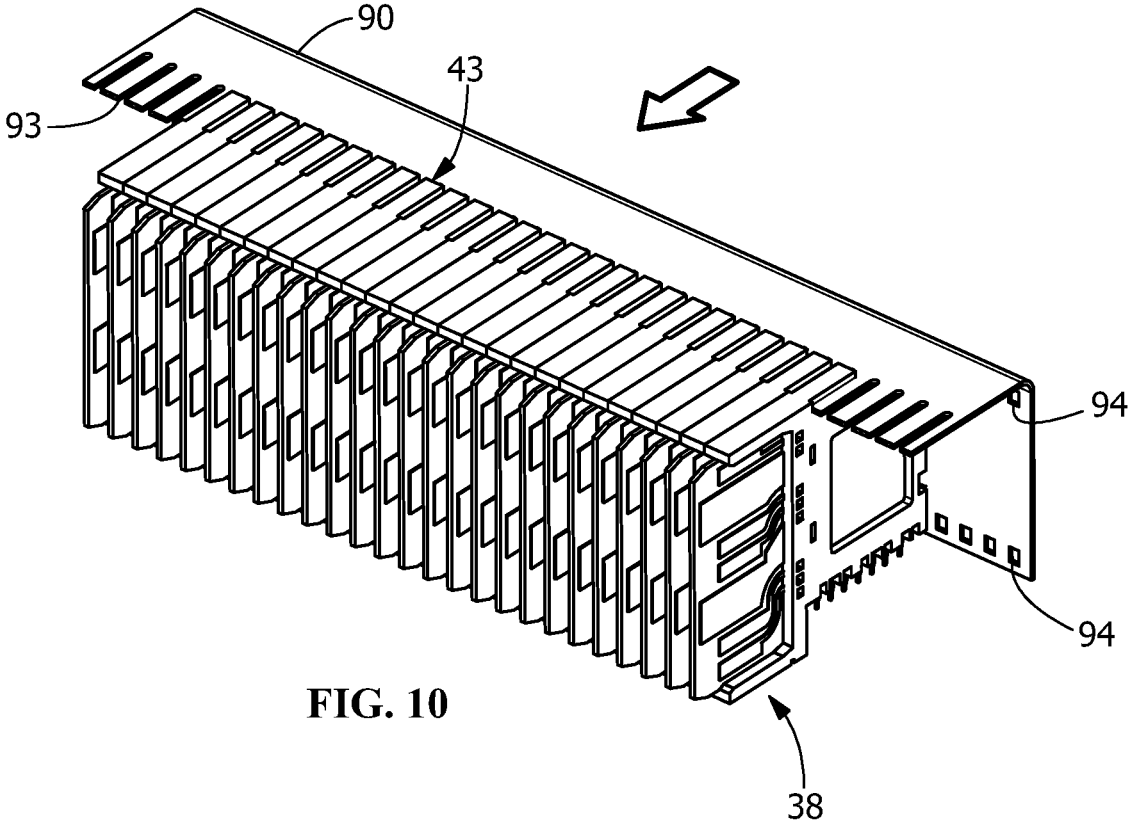
FIG. 10 is a lower perspective view of connector modules secured to the clip of FIG. 9 according to the present invention.

FIG. 2 is an elevation perspective view of an exemplary connector module 38 illustrating a module first side 50. Connector module 38 includes a protective overmolded contact module housing or housing 40 having a frame portion 42. At least a segment of frame portion 42 has a predetermined thickness 48 helping to maintain a desired separation or spacing between adjacent connector modules 38. When a plurality of connector modules 38 are collectively arranged between upper and lower shrouds 26, 28 such as shown in FIG. 1, collectively the frame portions 42 define a continuous shroud structure 102. Frame portion 42 includes an engagement feature 43, such as a pair of undercuts 45 (FIG. 2A) which engagement feature 43 is slidably received by slot 93 formed in leg 91 of clip 90 (FIG. 9) of upper shroud 26 (FIG. 1). Clip 90 includes a second leg 92 extending generally perpendicular to leg 91. Leg 91 includes openings 94 for receiving engagement features 47 formed in frame portion 42. As a result of slot 93 and openings 94 of clip 90 receiving corresponding engagement features 43, 47 of frame portion 42, clip 90 is thereby secured to connector module 38. FIG. 10 shows a plurality of connector modules 38 secured in corresponding engagement features of clip 90. Connector module 38 includes a mating end 52 that has a forward mating edge or back plane edge 54. The mating end 52 is configured to mate with a mating connector which may be a back plane connector (not shown in FIG. 2). The connector module 38 also includes a mounting edge or daughter board edge 56 through which extend contacts 18 in the lower housing 24 (FIG. 1) at the interface with the circuit board 12 (FIG. 1). The mounting edge 56 is substantially perpendicular to the mating edge 54. The connector module 38 has chamfered corners 58 at the mating end 52 to facilitate the mating process with the mating connector.

Figure 3:
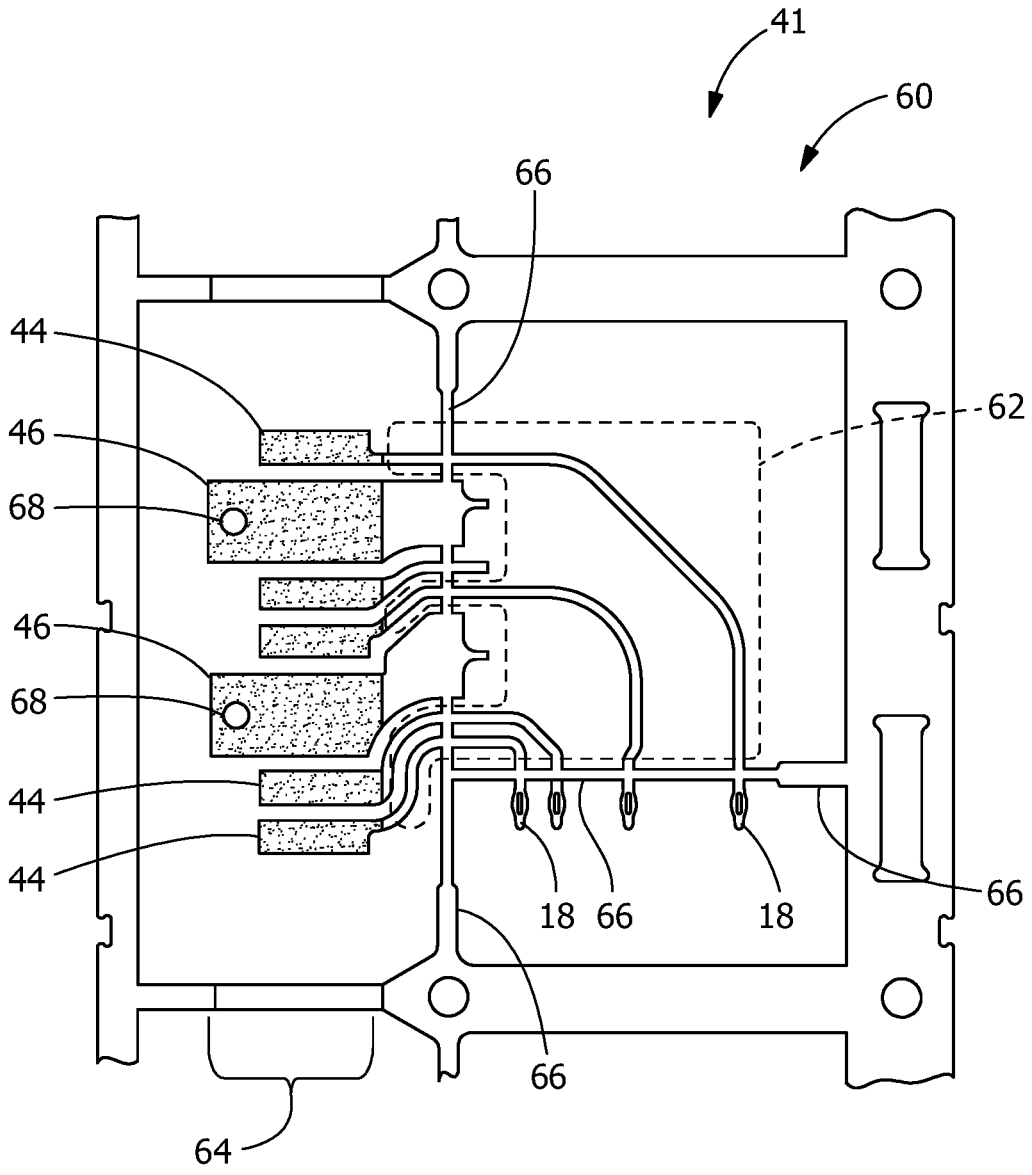
FIG. 3 is a partial elevation view of an exemplary leadframe according to the present invention.

In an exemplary embodiment, as shown in FIG. 3, a stamped contact leadframe or leadframe 60, such as used in a reel-to-reel manufacturing operation includes a suitable conductive material such as a conductive foil layer 41 of unitary construction including contacts 44 extending to contacts 18 via corresponding leads 62. That is, conductive signal leads 62 interconnect the signal contact pads 44 and contacts 18. Ground contacts 46 are positioned relative to contacts 44 as previously discussed. Carrier bars 66 of leadframe 60 are utilized in order to maintain the relative positions between stamped contacts 18, 44, 46 until after the protective housing 40 (FIG. 4) is formed. To improve electrical conductivity, portions of contacts 44, 46 may include a plated region 64, such as with a thin layer of gold or other highly conductive material. As further shown in FIG. 3, at least one of contacts 44, 46 may include a retention feature 68 (FIG. 3 only shows retention feature 68 in contacts 46), such as a chamfer, such as a chamfered opening that is utilized to secure contacts 46 in physical contact with housing 40, as will be discussed in further detail below. In one embodiment, the retention feature may be associated with a portion of the periphery of contacts 44, 46.

Figure 4:
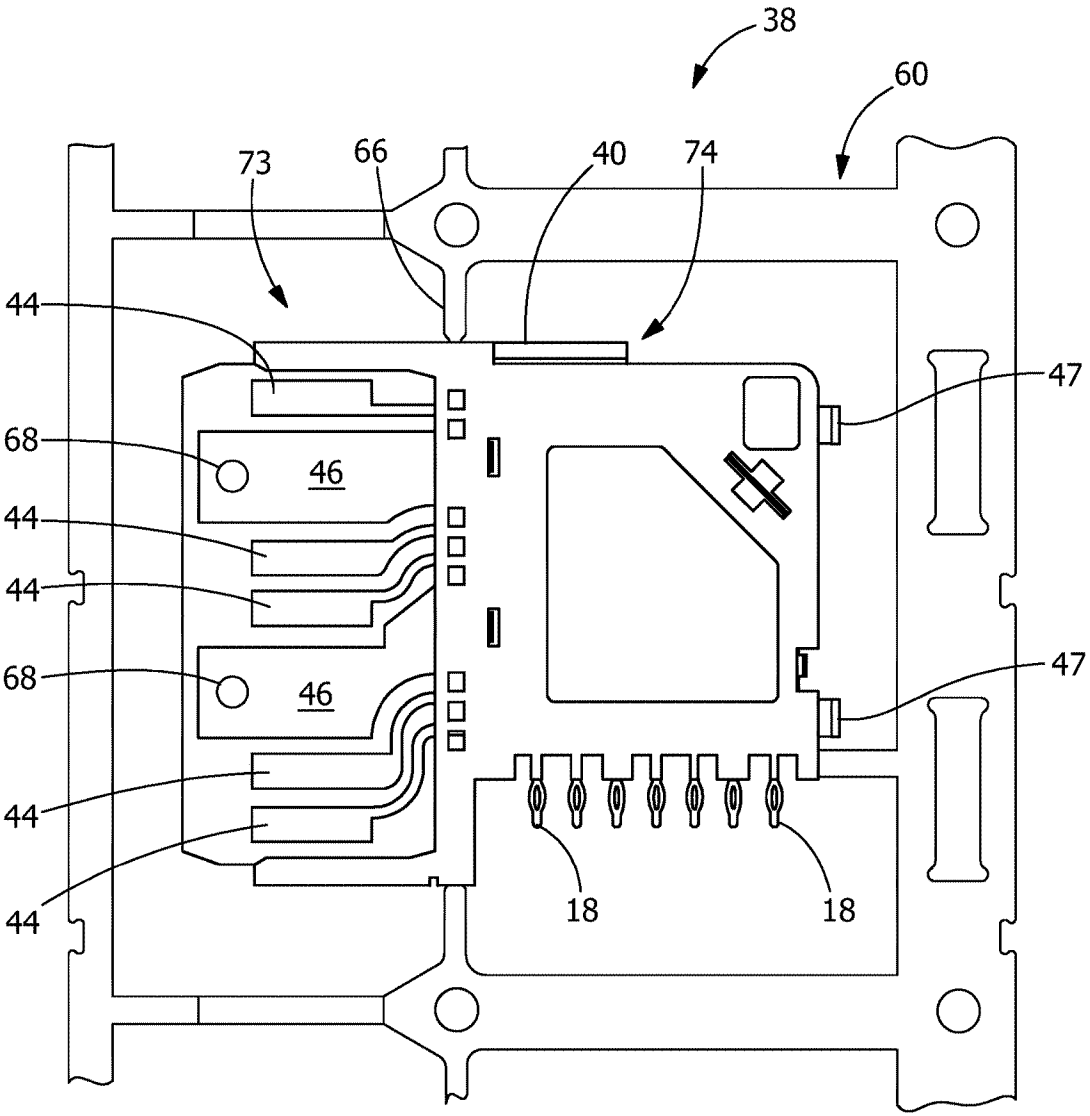
FIG. 4 is a partial elevation view of the leadframe covered by an exemplary protective housing according to the present invention.
Figure 4A:
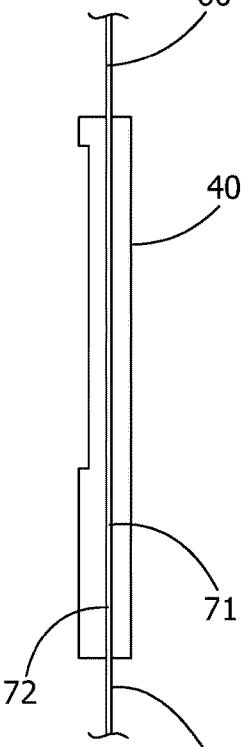
FIG. 4A is an end view of the covered leadframe of FIG. 4 according to the present invention.

As shown in FIGS. 4 and 4A, protective dielectric housing 40 is selectively formed over opposed surfaces 71, 72 (FIG. 4A) of leadframe 60. More specifically, portion 74 of housing 40 embeds leads 62 (FIG. 3) and portion 73 of housing 40 surrounds contacts 44, 46. That is, portion 73 is larger than and encompasses the collective footprint of contacts 44, 46 so as to protect the contacts in an unmated condition. For example, as shown in FIG. 2, backplate mating edge 54, which similarly defines the edge of portion 73 of housing 40, extends in direction A further than any of the ends of contacts 44, 46, and frame portion 42 of connector module 38 extends both upwardly and downwardly in direction B that is perpendicular to direction A, with frame portion 42 generally surrounding and structurally protecting contacts 44, 46 in an unmated position. During the formation, such as by molding of housing 40 over leadframe 60, portion 73 of housing 40 is applied in contact with surface 72 of contacts 44, 46. The term "in contact" may include partially embedding the peripheral edges of contacts 44, 46 with portion 73 of housing 40. However, surface 71 of contacts 44, 46 are exposed or not covered with portion 73 of housing 40, such that surface 71 of the contacts can be connected to and form an electrical connection with a corresponding contact of another electrical connector as previously discussed. Essentially simultaneously, material of portion 73 of housing 40 is flowed onto retention feature 68 of contacts 46. That is, as material of portion 73 of housing 40 is flowed and brought into contact with surface 72 of contacts 44, 46, the material similarly flows through and onto the portion of retention feature 68 that is associated with surface 71, such as the chamfered portion of a chamfered opening of an exemplary embodiment of retention feature 68. As a result, once the material of portion 73 of housing 40 has cured, the material of portion 73, for a retention feature 68 defining a chamfered opening, becomes the equivalent of a countersunk fastener head that secures surface 72 of contact 46 against or in contact with contact 46. That is, contact 46 is prevented from moving away from or becoming detached or delaminated from or relative to portion 73 of housing 40.

Figure 5:
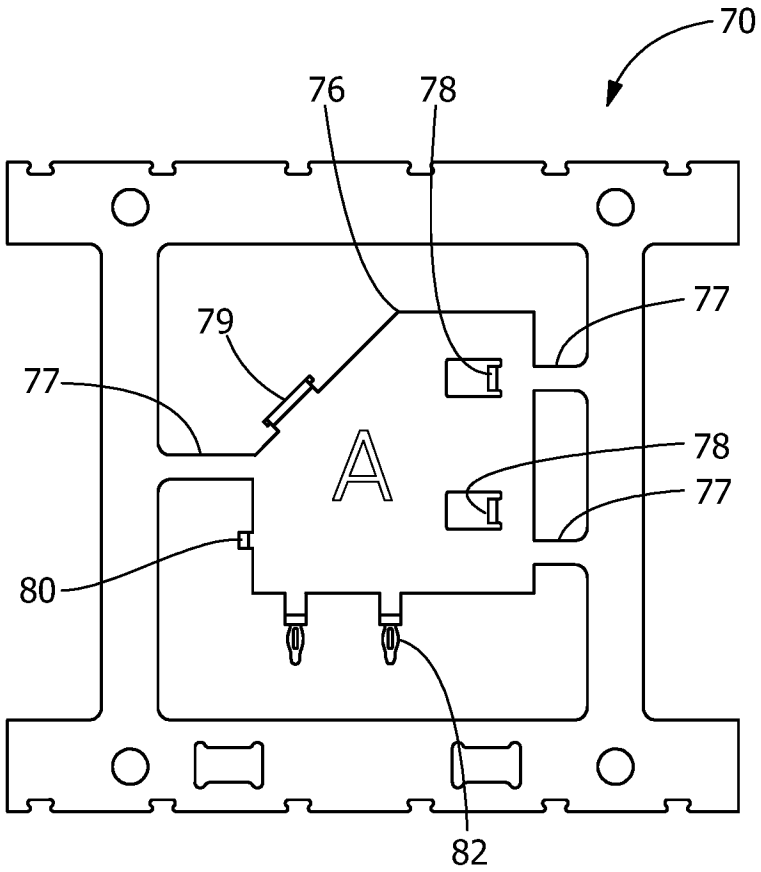
FIG. 5 is a partial elevation view of an exemplary leadframe of a ground member according to the present invention.
Figure 5A:
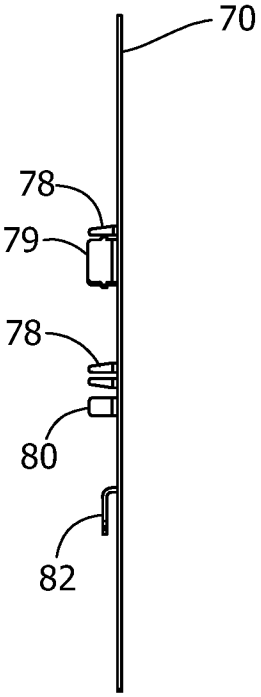
FIG. 5A is an end view of the leadframe of FIG. 5 according to the present invention.

FIGS. 5 and 5A show a stamped leadframe 70, similar to leadframe 60, which includes a suitable conductive material such as a conductive foil layer of unitary construction forming a communing member or ground shield or plate ground member 76. Ground member 76 is secured in position by carrier bars 77 in a manner as previously discussed. A plurality of retention features 78, 79, 80 extend generally perpendicularly to the body of ground member 76 so as to extend into and engage corresponding retention features when assembled with connector module 38 (FIG. 4). Additionally, ground contacts or contacts 82 extend outwardly and are laterally offset from the body of ground member 76 so as to align with corresponding contacts 18 (FIG. 4) of connector module 38 when assembled to the connector module. For example, the connector module 38 of FIG. 2 shows contacts 18, 82.

Figure 8:
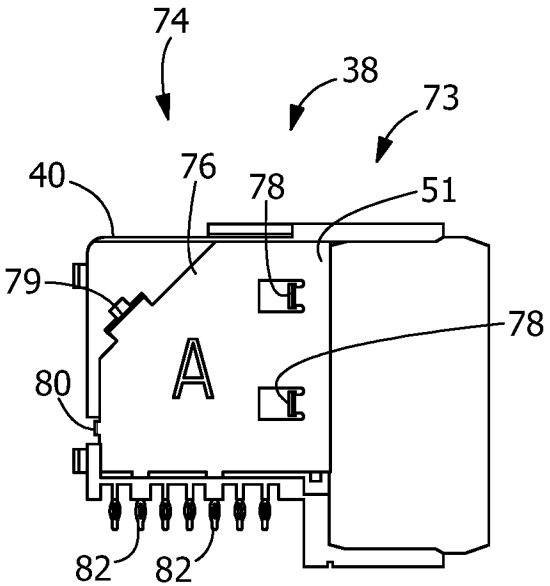
FIG. 8 is the freestanding leadframe covered by the protective housing of FIG. 7 rotated 180 degrees about a vertical axis according to the present invention.
Figure 7:
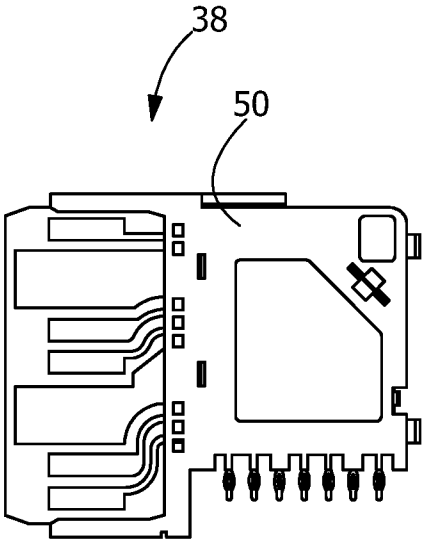
FIG. 7 is a freestanding leadframe covered by the protective housing of FIG. 4 according to the present invention.
Figure 6:
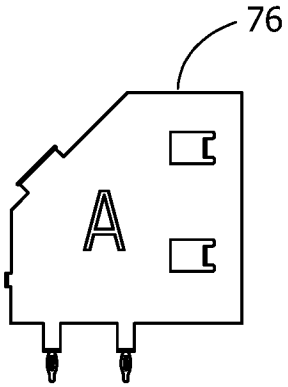
FIG. 6 is an elevation view of a freestanding ground member of FIG. 5 according to the present invention.

FIG. 6 shows ground member 76 removed from leadframe 70 (FIG. 5). FIG. 7 shows module first side 50 of connector module 38 prior to assembly of ground member 76. FIG. 8 shows a module second side 51 opposite that of module first side 50, with ground member 76 positioned overlying one side of a portion 74 of housing 40 and retention features 78, 79, 80 engaged with their corresponding retention features of connector module 38. More specifically, as a result of retention features 78 of ground member 76 engaging with corresponding engagement features 53 of contact 46 (FIG. 3), ground contacts or contacts 46 are in electrical communication with ground member 76, providing enhanced grounding capability by communing the ground contacts. U.S. Pat. No. 7,637,767 titled CABLE CONNECTOR ASSEMBLY and U.S. Pat. No. 7,566,247 titled SKEW CONTROLLED LEADFRAME FOR A CONTACT MODULE ASSEMBLY, each issued to Applicant, further discussing communing members (e.g., FIG. 5 and FIG. 7, respectively) and corresponding structure are incorporated by reference in their entirety.

Figure 12:
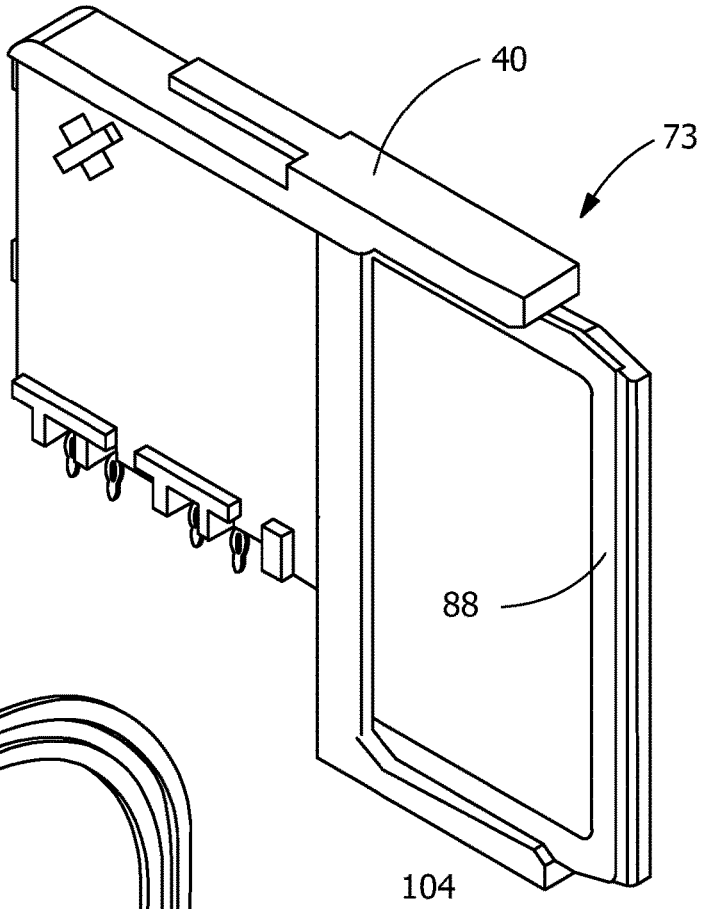
FIG. 12 is a partial elevation view of an exemplary connector module including the freestanding leadframe of FIG. 11 according to the present invention.
Figure 11:
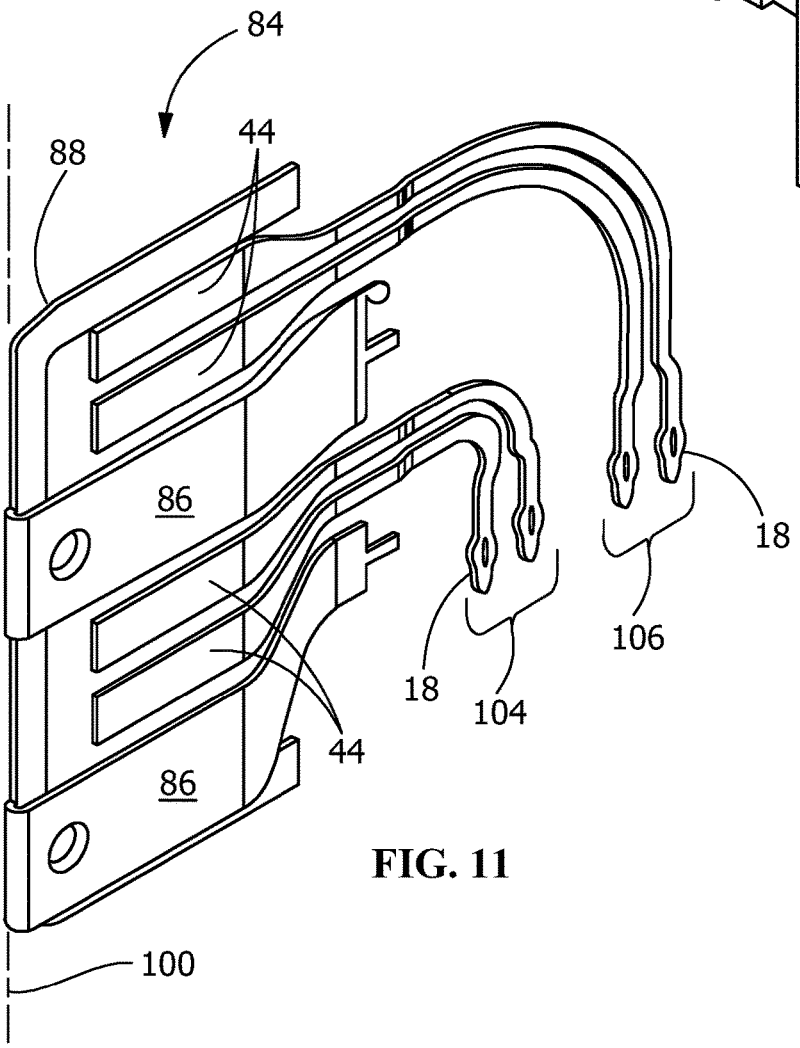
FIG. 11 is a perspective view of an exemplary freestanding leadframe according to the present invention.

As shown in FIG. 11, stamped layer 84, which is similar to stamped layer 41 of FIG. 3, includes a ground member or ground bar 88 to which corresponding ends of ground contacts 86 are secured. Ground bar 88 is of unitary or one-piece construction with ground contacts 86. Ground bar 88 is rotated 180 degrees about an axis 100 that is transverse to ground contacts 86. Ground bar 88 is generally U-shaped, with parallel legs of the U-shaped ground bar extending generally parallel to and in protective close proximity to corresponding contacts 44, 86. In one embodiment, ground bar 88 is arranged such that the ground bar not require rotation about the transverse axis 100, as the parallel legs of the ground bar are positioned in stamped layer 84 essentially as shown in FIG. 11. In one embodiment, at least the region of the ground bar 88 along axis 100 contains a joggle. As shown, contacts 44, 86 are positioned between the parallel legs of the U-shaped ground bar 88. This ground bar construction effects an electrostatic discharge strip to the front of the connector (i.e., opposite pins 18), as well as adding strength, rigidity and protective capability to the resulting connector. As further shown in FIG. 12, ground bar 88 is at least partially surrounded by portion 73 of housing 40.

Figure 15:
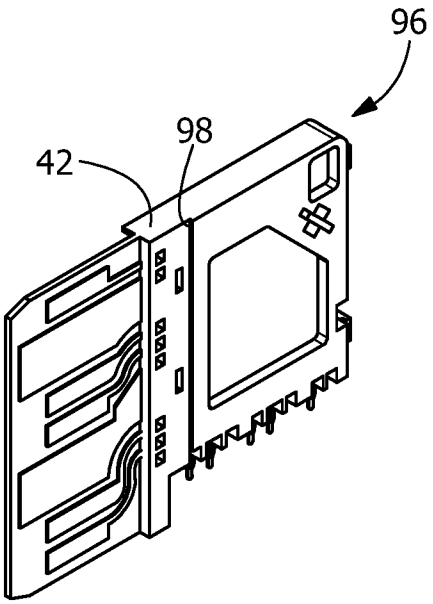
FIG. 15 is a perspective view of a connector module of FIG. 13 according to the present invention.
Figure 14:
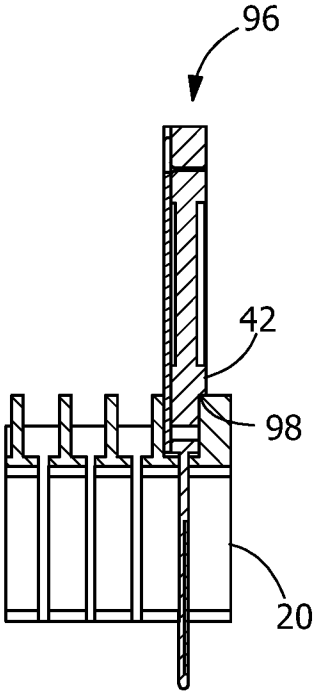
FIG. 14 is a cross-section taken along line 14-14 of the connector module of FIG. 13 according to the present invention.
Figure 13:
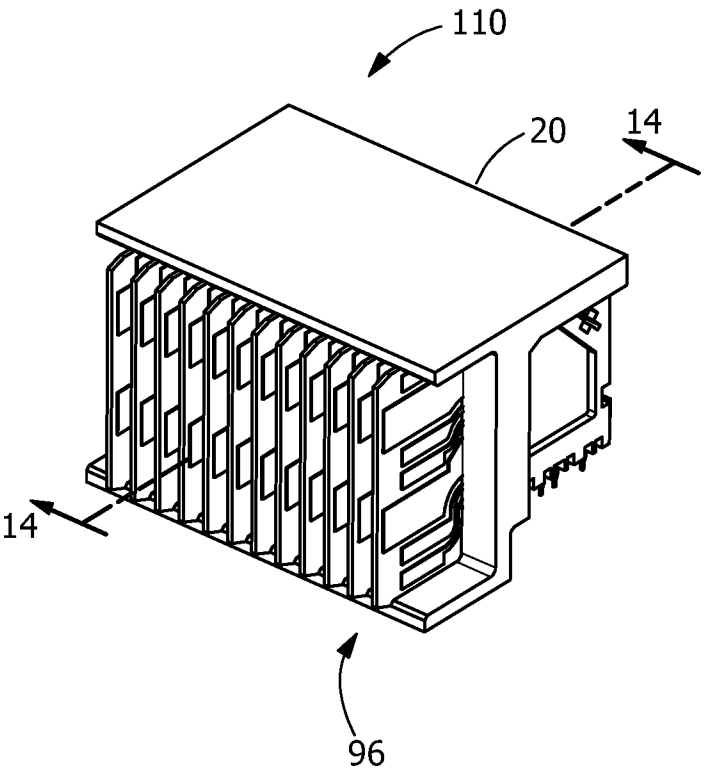
FIG. 13 is a perspective view of an exemplary connector according to the present invention.

Shown in FIGS. 13-15, an alternate embodiment of an electrical connector 110 is now discussed. As shown in FIG. 14, which is a cross-section taken along line 14-14 of FIG.

13, frame portion 42 connector module 96 includes a notch 98 usable for providing an insertion/alignment feature of the connector.

Figure 17:
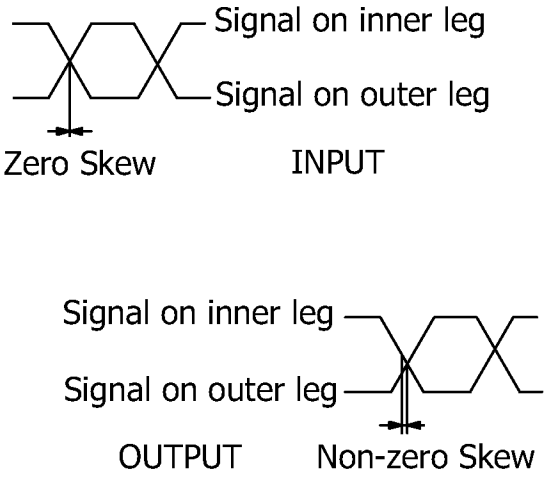
FIG. 17 is a graphical representation of input/output signals from a contact pair of the connector module of FIG. 16 according to the present invention.
Figure 16:
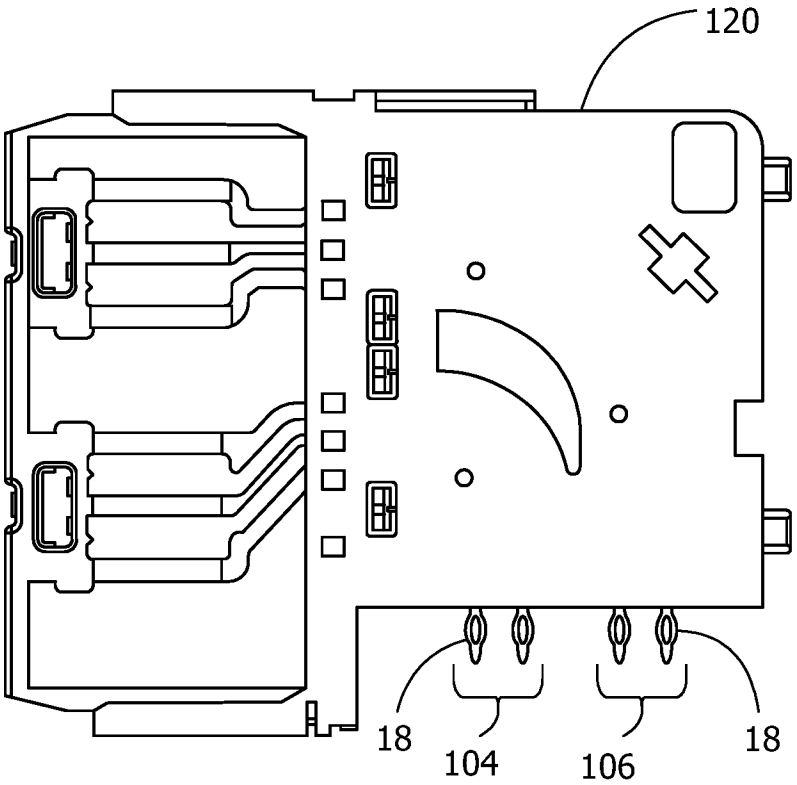
FIG. 16 is an elevation view of an exemplary connector module according to the present invention.

FIGS. 16-19 discuss an alternate embodiment of a housing 140 of an electrical connector using contact pairs for differential signaling, such as contact pairs 104, 106 (FIG. 11). For such contact pairs 104, 106, as a result of the 90 degree turn within the right-angle connector, one leg (inner leg) of the contact pair is physically shorter than the other leg (outer leg), resulting in an electrical signal propagation delay or propagation delay, sometimes referred to as intra-pair skew or skew or jitter (transmission bandwidth decreases) through the legs of contact pairs 104, 106 between the input and output sides of the contact pairs. That is, as shown in FIGS. 16-17 for housing 120 (FIG. 16), while an input signal to the inner and outer legs of contact pairs 104, 106 has zero skew (FIG. 17), the output signal from the inner and outer legs of contact pairs 104, 106 has a non-zero skew (FIG. 17), which is undesirable.

Figure 19:
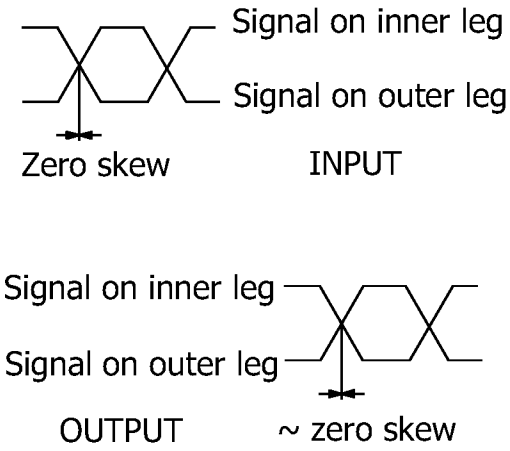
FIG. 19 is a graphical representation of input/output signals from a contact pair of the connector module of FIG. 18 according to the present invention.
Figure 18:
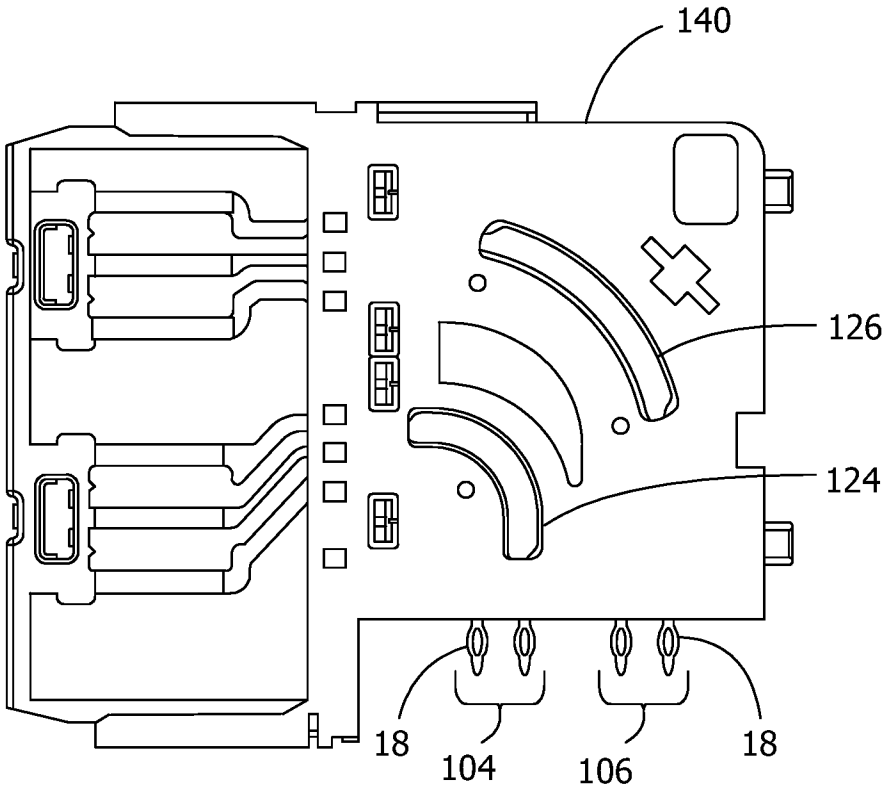
FIG. 18 is an elevation view of an exemplary connector module according to the present invention.

In contrast, as shown in FIGS. 18-19 for housing 140 (FIG. 16), as a result of the addition of electrical propagation delay features 124, 126, the output signals from the inner and outer legs of respective contact pairs 104, 106 have a skew that is approximately equal to zero, or approximately (~) zero skew (FIG. 19). As shown in FIG. 18 electrical propagation delay features 124, 126, also referred to as skew flags, introduce an air pocket over a portion of each of the outer legs of respective contact pairs 104, 106, decreasing propagation delay of the outer legs (i.e., increasing velocity of signal propagation) due to lowering the relative permittivity. As a result, it is possible to size the electrical propagation delay features 124, 126 to achieve an intra-pair skew of approximately zero (pico-)seconds. Although introducing the air pocket increases the differential impedance between the inner and outer legs of the contact pairs, widening the portion of the outer leg exposed to the air pocket can restore the impedance balance.

As appreciated by one having ordinary skill in the art, a method of forming a connector 10, such as by a reel-to-reel manufacturing process includes positioning a contact leadframe 60 of unitary construction including contacts 44 extending to second contacts 18 via corresponding leads 62, and forming a protective overmolded contact module housing 40 over the leadframe 60, forming a connector module 38, the housing 40 embedding the leads 62 and surrounding the contacts 44, the contacts 18 extending from the housing 40, with a side or surface 72 of the contacts 44 in contact with the housing 40, and an opposed side 71 or surface of the contacts 44 being exposed, and positioning a plurality of connector modules 38 in an aligned arrangement.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a contact leadframe of unitary construction including first contacts extending to second contacts via corresponding leads; and an overmolded contact module housing formed over the leadframe, forming a connector module, the housing embedding the leads and surrounding the first contacts, the second contacts extending from the housing, a first surface of the first contacts in contact with the housing, and an opposed second surface of the first contacts being exposed;

wherein the connector includes a plurality of connector modules positioned in an aligned arrangement.

2. The electrical connector of claim 1 further comprises a third contact positioned in close proximity to the first contacts and surrounded by the housing, a first surface of the third contact in contact with the housing, and an opposed second surface of the third contact being exposed; and a ground member connected to the third contact.

3. The electrical connector of claim 1, wherein at least one contact having a retention feature, the retention feature retaining housing material flowed onto the retention feature from the first surface of the at least one contact, thereby preventing the first surface of the at least one contact from moving away from the housing.

4. The electrical connector of claim 3, wherein the retention feature is a chamfer.

5. The electrical connector of claim 2, wherein the ground member is positioned overlying one surface of a portion of the housing.

6. The electrical connector of claim 5, wherein the ground member is a plate.

7. The electrical connector of claim 5, wherein the ground member is a separate component from the leadframe, secured to the third contact, and at least partially surrounded by the housing.

8. The electrical connector of claim 1, wherein the leadframe further comprises a generally U-shaped ground bar.

9. The electrical connector of claim 1, wherein the housing includes a frame portion having a predetermined thickness.

10. The electrical connector of claim 9, wherein the frame portion includes a first engagement feature.

11. The electrical connector of claim 9, wherein the frame portion includes a second engagement feature.

12. The electrical connector of claim 10 further comprises a clip having a first leg and a second leg, the first leg having a slot to slidably receive the first engagement feature.

13. The electrical connector of claim 11, wherein the second leg having an opening to receive the second engagement feature.

14. The electrical connector of claim 9, wherein the frame portion has a notch.

15. The electrical connector of claim 9, wherein collectively, the frame portions of the housings of the plurality of arranged connector modules define a continuous shroud structure.

16. The electrical connector of claim 1, wherein the housing further comprises an electrical signal propagation delay feature.

17. An electrical connector comprising:

a contact leadframe of unitary construction including first contacts extending to second contacts via corresponding signal leads and a third contact positioned in close proximity to the first contacts;

an overmolded contact module housing formed over the leadframe, forming a connector module, the housing embedding the leads and surrounding the first contacts and the third contact, the second contacts extending from the housing, a first surface of each of the first contacts and the third contact in contact with the housing, and an opposed second surface of each of the first contacts and the third contact being exposed; and a ground member connected to the third contact;

wherein the connector includes a plurality of connector modules positioned in an aligned arrangement.

18. A method of forming a connector comprising:

positioning a contact leadframe of unitary construction including first contacts extending to second contacts via corresponding signal leads;

forming an overmolded contact module housing over the leadframe, forming a connector module, the housing embedding the leads and surrounding the first contacts, the second contacts extending from the housing, a first surface of the first contacts in contact with the housing, and an opposed second surface of the first contacts being exposed; and positioning a plurality of connector modules in an aligned arrangement.

19. The method of claim 18, wherein positioning a contact leadframe of unitary construction further includes positioning a third contact in close proximity to the first contacts, and wherein forming an overmolded contact module housing over the leadframe further includes surrounding the third contact, a first surface of the third contact in contact with the housing, and an opposed second surface of the third contact being exposed.

20. The method of claim 18, wherein forming an overmolded contact module housing over the leadframe includes flowing housing material into a retention feature formed in the third contact from the first surface of the third contact, thereby preventing the first surface of the third contact from moving away from the housing.

* * * * *